US006009600A

United States Patent [19]

Egeland et al.

[11] Patent Number: 6,009,600

[45] Date of Patent: Jan. 4, 2000

[54] TOOL HANDLE

[76] Inventors: James J. Egeland, 632 109th. La. NE., Blaine, Minn. 55434; Dallas D. Carlson, 6880 Sunnyslope Dr., Maple Grove, Minn. 55311; Jeffrey R. Gibas, 9381 Xenium La., Maple Grove, Minn. 55369

[21] Appl. No.: 09/100,301

[22] Filed: Jun. 19, 1998

[51] Int. Cl.[7] ..... A47B 95/02

[52] U.S. Cl. ..... 16/436; 81/177.1; 81/489; 81/20; 16/430

[58] Field of Search ..... 16/110 R, 110 A, 16/111 R, 114 R, DIG. 12, DIG. 19; 30/295, 291, 286; 74/551.9; 81/177.1, 489, 20–25; D8/80, 303, 300, 313, 315; D7/648; 7/143, 167; 173/162.2; 294/57, 58

[56] References Cited

U.S. PATENT DOCUMENTS

| | | | |
|---|---|---|---|
| 108,141 | 10/1870 | Houseman et al. | 30/295 |
| D. 143,228 | 12/1945 | Levering | 30/295 |
| 271,303 | 1/1883 | Blaker | 81/20 |
| 1,386,342 | 8/1921 | Letchworth | 295/57 |
| 3,227,455 | 1/1966 | Hulsman | 16/111 R |
| 3,425,468 | 2/1969 | Soucy | 81/20 |
| 4,236,270 | 12/1980 | Mavis . | |
| 4,493,494 | 1/1985 | Feagin, Jr. | 16/110 R |
| 4,548,248 | 10/1985 | Riemann | 81/20 |
| 4,613,156 | 9/1986 | Lajos . | |
| 4,641,857 | 2/1987 | Gailiunas . | |
| 4,683,784 | 8/1987 | Lamont . | |
| 4,850,079 | 7/1989 | Thompson | 16/111 R |
| 4,882,956 | 11/1989 | Lang | 81/20 |
| 4,885,818 | 12/1989 | Arterbury . | |
| 4,934,024 | 6/1990 | Sexton . | |
| 5,149,160 | 9/1992 | Iioa . | |
| 5,535,484 | 7/1996 | Gibson | 16/111 R |
| 5,546,832 | 8/1996 | Townsend | 81/20 |
| 5,588,343 | 12/1996 | Rust . | |
| 5,606,772 | 3/1997 | Ilic . | |
| 5,622,352 | 4/1997 | Swindoll . | |
| 5,647,080 | 7/1997 | Martin . | |
| 5,680,676 | 10/1997 | Spirk et al. | 16/110 A |
| 5,692,265 | 12/1997 | Dalury . | |
| 5,704,259 | 1/1998 | Riehle | 81/22 |

OTHER PUBLICATIONS

Grainger, Inc., Fall 1993, General Catalog, 1993, pp. 1037–1042, USA.

Ben Meadows Co., Equipment for Natural Resources Managers, 1996, Atlanta, GA, USA, pp. 72–74.

V&B Manufacturing Co., Quality Replacement Handles, 4 pgs., Walnut Ridge, AR, USA, date unknown.

*Primary Examiner*—Chuck Y. Mah

*Attorney, Agent, or Firm*—Patent Smart, PLLP; Claude T. Anderson; Charles R. Steffel

[57] ABSTRACT

A new tool handle for providing an improved grip and improved control and accuracy for use with striking tools such as hammers of various types as well as multipurpose tools such as hatchets. The inventive device includes a shaft, a thumb ramp, and a finger shield fixedly attached to the shaft. The thumb ramp provides for improved accuracy and control of the tool during use by allowing the thumb to help guide the handle. The finger shield serves to protect the knuckles and outer surface of the hand from abrasive injury during use. The finger shield also serves to physically restrain the tool in event of a loss of grip during use.

8 Claims, 4 Drawing Sheets

TOOL HANDLE

BACKGROUND OF THE INVENTION

1. Field of the Invention

The present invention relates to hand tools generally and more particularly pertains to a new handle for providing an improved grip as well as improved accuracy and control for use with striking tools such as hammers of various types as well as multipurpose tools such as hatchets.

2. Description of the Prior Art

The use of striking tools is well known in the prior art. A striking tool generally consists of the tool head and a fixed handle. The present invention relates to an improved handle. For many years, various modifications have been made to striking tool handles to improve the grip characteristics. More specifically, the use of hammers to drive fasteners such as nails has been known to consist basically of familiar, expected and obvious structural configurations, notwithstanding the myriad of designs encompassed by the crowded prior art which have been developed for the fulfillment of countless objectives and requirements.

known prior art handles for striking tools include U.S. Pat. No. 4,934,024 by Sexton; U.S. Pat. No. 5,692,265 by Dalury; U.S. Pat. No. 5,622,352 by Swindoll; U.S. Pat. No. 5,647,080 by Martin; U.S. Pat. No. 5,588,343 by Rust et al. and U.S. Pat. No. 4,683,784 by Lamont.

Numerous embodiments of prior art striking tools are provided in Grainger Industrial and Commercial Equipment and Supplies, Fall 1993, General Catalog No. 384, pp. 1037, 1038, 1040, 1041 and 1042. These illustrations depict the variety of striking tools and available handles that are available. None of these embodiments describe a striking tool handle that provides a finger shield for enclosing the hand while shielding the fingers and knuckles from impact or abrasion and a thumb rest for allowing the thumb to stabilize and control the tool.

Further embodiments of prior art striking tools are provided in Ben Meadows Company, Equipment for Natural Resource Managers, 1996, pp 72–74. Item no. 161331 on page 73 discloses a leather grip with a metal guard attached to a blade, and Item no. 160070 on page 74 discloses an injection-molded polypropylene handle attached to a blade. Neither tool includes the type of thumb rest that would allow the thumb of the tool user to be utilized in controlling the tool.

It must be understood that previous striking tool handles do not have the features of the present invention. U.S. Pat. No. 4,934,024 by Sexton describes a process for making a moldable plastic handle designed to conform to the user's hand. This process produces a unique tool handle that is only suitable for one user.

U.S. Pat. No. 5,692,265 by Dalury illustrates an ergometric handle to increase comfort and control over a hand tool. Although the handle provides a thumb indentation, it does not disclose a thumb ramp designed to position the user's thumb so that it is balanced axially above the centerline of the handle.

U.S. Pat. No. 5,622,352 by Swindoll discloses a connected arch member on a conventional hammer handle. The purpose of the arch is to aid with the nail pulling function of a claw hammer and is not related to the nail driving capabilities of a claw hammer.

U.S. Pat. No. 5,588,343 by Rust et al. describes a composite handle providing an improved grip utilizing synthetic plastic compounds.

While these devices fulfill their respective, particular objectives and requirements, the aforementioned patents do not disclose a new tool handle for use on striking tools that has a shaft, thumb ramp and finger shield.

Conventional handles can be constructed from various materials such as wood, steel, fiberglass, plastic or composites consistent with the specific intended application for a particular tool head. However, conventional prior art handles suffer from a number of deficiencies. Hand tools are often used in environmental extremes that range from dry to wet as well as hot to cold. In wet or hot conditions, a hammer handle can become wet making it slippery and difficult to hold on to. Since normal use often requires swinging hand tools with a good deal of force unintentional loss of grip while using a conventional handle often results in the tool becoming an oat of control flying projectile creating a potentially dangerous situation.

Furthermore, there are large numbers of individuals with nerve or muscular problems or other physical limitations or physical characteristics, such as having a small body frame, that result in their having a weak handgrip. For these individuals obtaining a good grasp on a conventional handle is difficult to impossible even under ideal conditions. These individuals may have adequate upper body strength for using hand tools, while being unable to utilize a hand tool because of the concern over losing their handgrip while swinging the hand tool, creating a potentially dangerous situation.

Furthermore, conventional tool handles do not provide any protection from scrapes or abrasive injury for the individuals knuckles or outer surface of the hand during use. This results in injury to the hand when the hand inadvertently contacts an object during use of the tool.

Independently of the limitations of maintaining a hold of the grip, a second limitation arises for conventional shaped tool handles. Prior art handles are designed to orientate the individual user's thumb to wrap around the user's fingers to further secure the grip. With the user's thumb substantially parallel to the user's fingers, all side to side control of the hammer is substantially provided by the palm of the user's hand. Since the thumb is unavailable to provide side to side control, loss of control can occur. This can result in meaning of the work surface or even a bruised thumb or finger when the user is holding a nail to start it and inadvertently hits a finger while trying to start the nail.

The inventive device is a tool handle that includes a shaft, thumb ramp and finger shield In these respects, the tool handle according to the present invention substantially departs from the conventional concepts and designs of the prior art, and in so doing provides an apparatus primarily developed for the purpose of providing a substantially improved tool handle for use with striking tools.

SUMMARY OF THE INVENTION

In view of the foregoing disadvantages inherent in the known types of tool handles for use on a striking tool now present in the prior art, the present invention provides a new tool handle for use on a string tool herein the same can be utilized for providing an improved grip during use.

The general purpose of the present invention, which will be described subsequently in greater detail, is to provide a new tool handle for use on a striking tool which has many of the advantages of the tool handles mentioned heretofore and many novel features that result in a new tool handle which is not anticipated, rendered obvious, suggested, or even implied by any of the prior art tool handles, either alone or in any combination thereof.

To attain this, the present invention generally comprises a shaft, a thumb ramp and a finger shield.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new tool handle for use on a striking tool which has many of the advantages of tool handles mentioned heretofore and several novel features that result in a new tool handle for use on a striking tool which is not anticipated, rendered obvious, suggested, or even implied by any of the prior art tool handles, either alone or in any combination thereof.

Still yet another object of the present invention is to provide a new tool handle which provides in the apparatuses of the prior art some of the advantages thereof, while simultaneously overcoming some of the disadvantages normally associated therewith.

It is another object of the present invention to provide a new tool handle which may be safely used in the hand of an individual with a weak grip, due to handicap, fatigue or other reasons with greatly reduced risk of unintentional release while swinging the tool.

It is another object of the present invention to provide a new tool handle which will provide protection to the knuckles and outer surface of the individual user's hand during such use.

It is another object of the present invention to provide a new tool handle in which the thumb of the individual user may be effectively utilized to provide increased accuracy and control of the tool during normal use.

It is another object of the present invention to provide a new tool handle in which the thumb of the individual user may be effectively utilized to provide increased accuracy and control of the tool during use, particularly for an individual who is inexperienced in the use of the tool, or has a weak grip, as a result of a handicap, fatigue or other reasons.

It is another object of the invention to provide a new tool handle that is equally suited for use by right-handed and left-handed individuals.

It is another object of the invention to provide a new tool handle that can be manufactured from hardwoods, cast and extruded metals, molded plastics, fiberglass and epoxy resins or composite materials such as polypropylene plastic over a fiberglass core.

It is another object of the present invention to provide a new tool handle which may be easily and efficiently manufactured and marketed.

It is a further object of the present invention to provide a new tool handle which is of a durable and reliable construction.

An even further object of the present invention is to provide a new tool handle which is susceptible of a low cost of manufacture with regard to both materials and labor, and which accordingly is then susceptible of low prices of sale to the consuming public, thereby making such tool handle economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
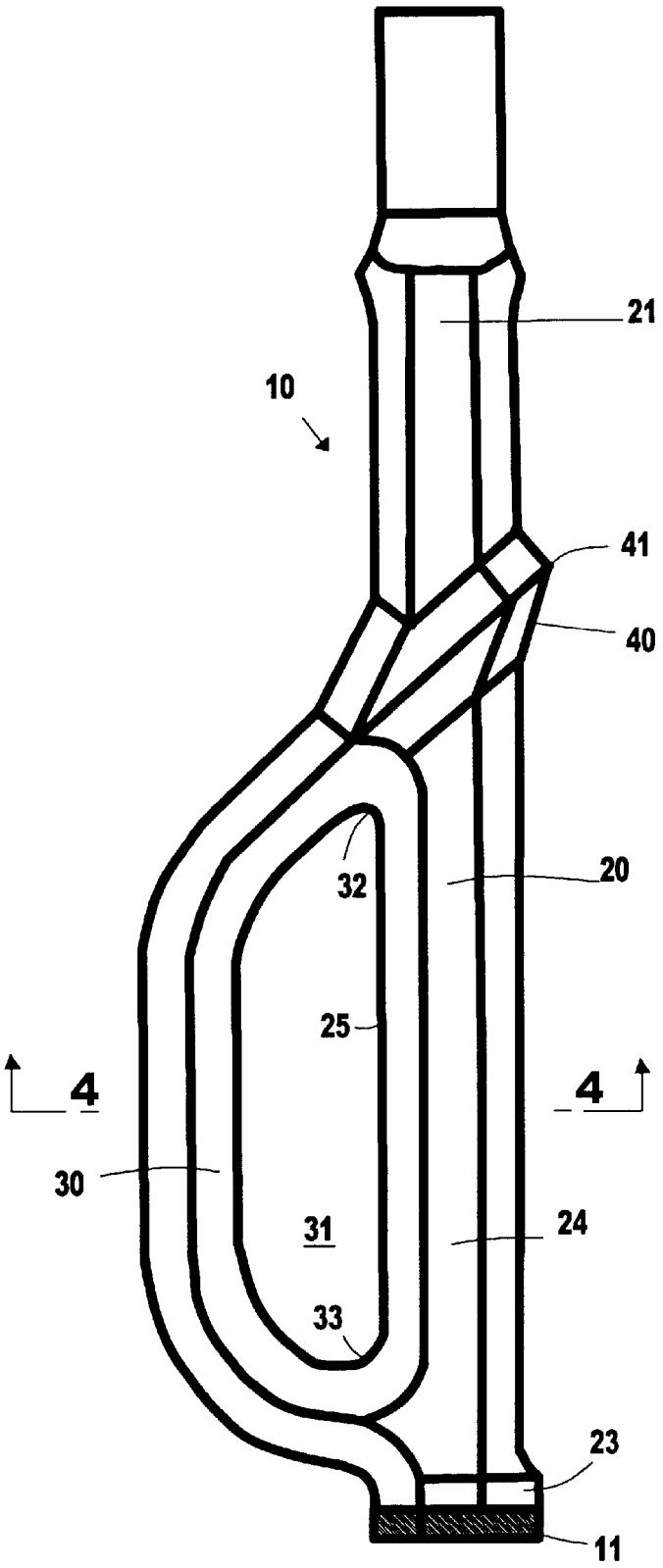
FIG. 1 is a side elevation view of a new tool handle according to the present invention.

With reference now to the drawings, a new tool handle embodying the principles and concepts of the present invention and generally designated by the reference numeral 10 will be described. Materials of construction for the tool handle typically include select hardwoods, cast and extruded metals, molded plastics, fiberglass and epoxy resins.

Figure 2:
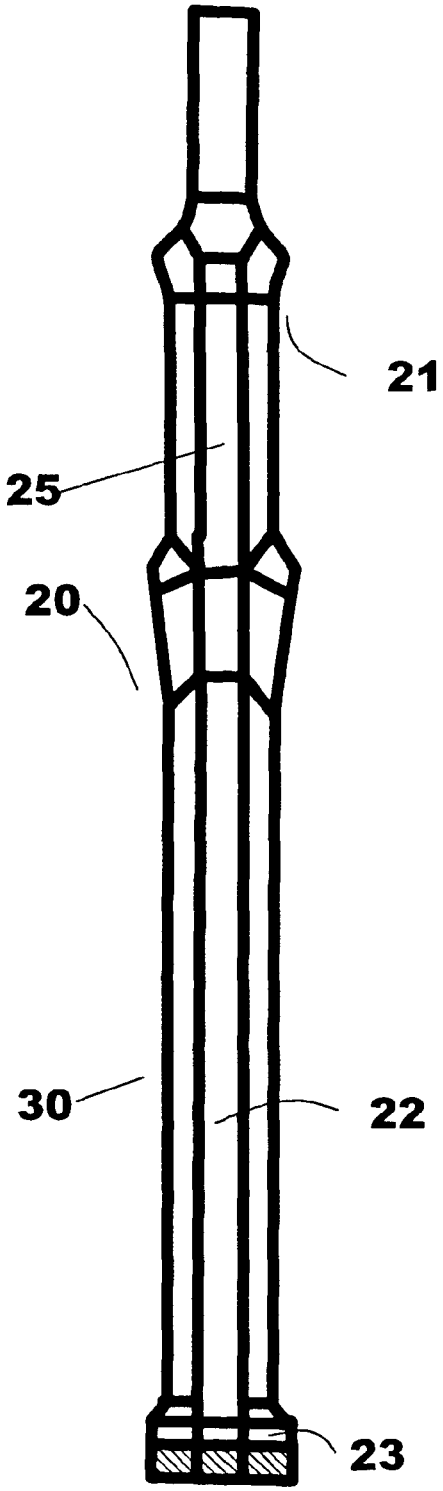
FIG. 2 is a bottom plan view of the finger shield side of the present invention.
Figure 3:
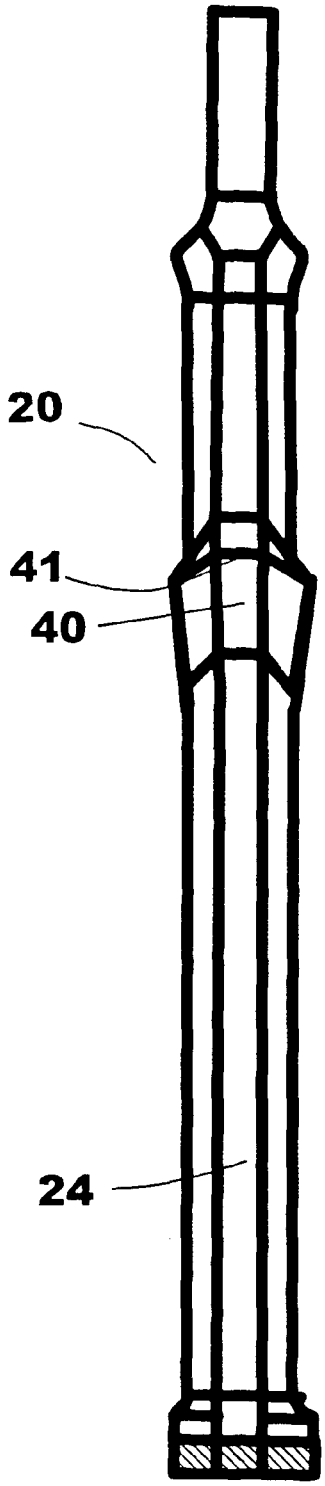
FIG. 3 is a top plan view of the thumb ramp side of the present invention.
Figure 4:
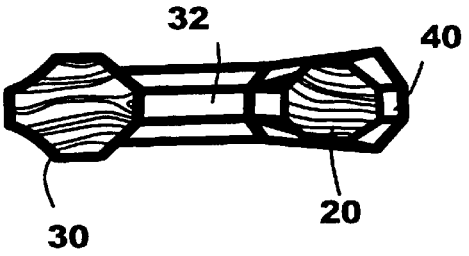
FIG. 4 is a cross sectional view taken along line 4—4 of FIG. 1.
Figure 5:
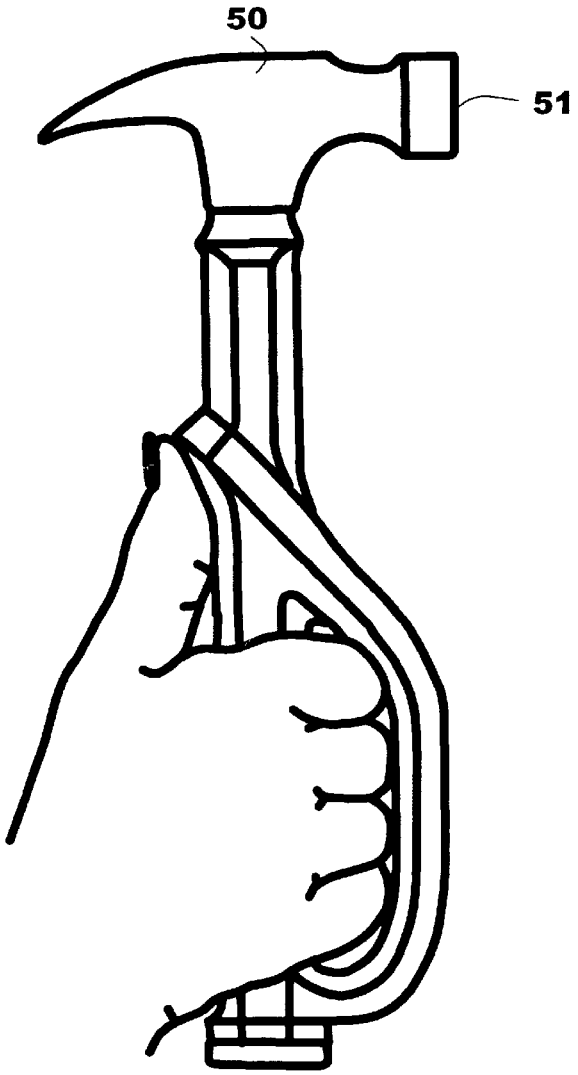
FIG. 5 is an elevational side view of the present invention showing hand position during normal use.

More specifically, with reference to FIG. 1 and FIG. 5 it will be noted that the tool handle (10) comprises a shaft (20), a finger shield (30) and a thumb ramp (40). The shaft (20) is composed of a grip portion (22), a bead end (21) and a free end (23). The grip portion (22) is disposed between the head end (21) and free end (23). The head end (21) is adapted to receive a tool head (50) with a striking surface (51). The shaft further having an upper shaft surface (24) and a lower shaft surface (25). The lower shaft surface (25) as shown in FIG. 2 is substantially parallel to the striking surface (51)

and is positioned on the same side of the tool handle (10) as the striking surface (51). The upper shaft surface (24) as shown in FIG. 3, is immediately adjacent and adjoined to the lower shaft surface (25). The upper shaft surface (24) is on the opposite side of the tool handle (10) as the lower shaft sac (25). The thumb ramp (40) being of sufficient size to support the user's thumb, is placed on the upper shaft surface (24) between the grip portion (22) and the head end (21). The thumb ramp (40) includes a thumb ramp apex (41) formed above the shaft (20). The thumb ramp (40) is positioned to provide a comfortable surface adequate to place the user's thumb. The finger shield (30) is fixedly attached to the lower shaft surface (25), substantially opposite the thumb ramp (40). The finger shield (30), having a generally arcuate shape in the preferred embodiment, forms a hand passage (31) with the grip portion (22). The hand passage (31) being large enough to accommodate free passage of the user's fingers and palm. The finger shield (30) further having a forward hand lock (32) and a rearward hand lock (33). The forward hand lock (32) is located on the lower shaft surface (25) adjacent to the head end (21). The rearward hand lock (33) is located adjacent to the free end (23) of the shaft (20). A bumper pad (11) can be fixedly attached to the free end (23). The bumper pad (11) is generally composed of a resilient plastic or rubber material to allow positioning a work object by lightly tapping with the tool handle free end (23) without marring the surface of the work object.

The size of the shaft (20), finger shield (30) and the thumb ramp (40) can be manufactured to correspond to varying hand sizes and tool applications. For instance a tool handle designed for an individual with a small hand would have a correspondingly smaller finger shield (30), thumb ramp (40) and hand passage (31).

Figure 7:
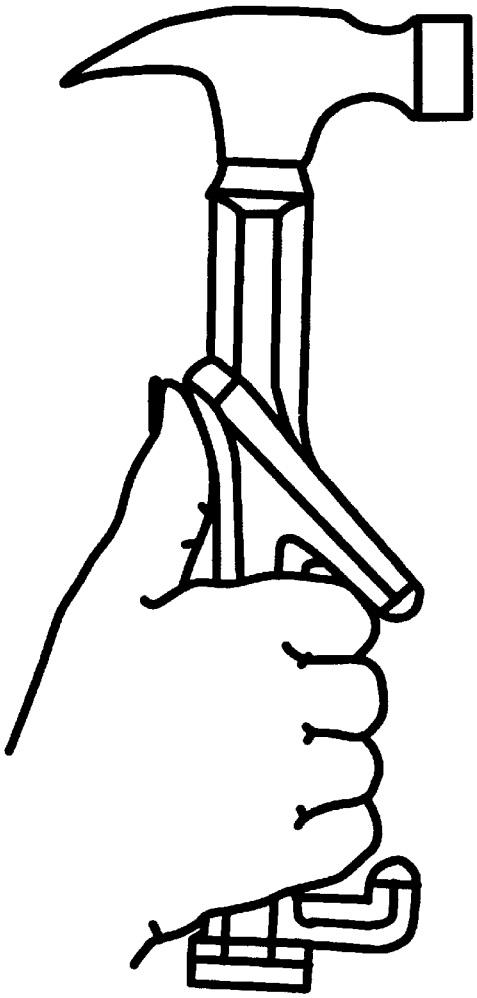
FIG. 7 is an elevational side view of the present invention showing an alternative embodiment with a discontinous finger shield.

Furthermore, other variations on the finger shield (30) are possible. For instance, as shown in FIG. 7 the finger shield (30) does not necessarily need to be a single continuous piece throughout. The forward hand lock (32) and rearward hand lock (33) can be cantilevered from the lower shaft surface (25) and provide substantial protection of the outer hand and knuckles of the user. This embodiment retains the benefits of the benefits of the invention in an alternative design.

Figure 6:
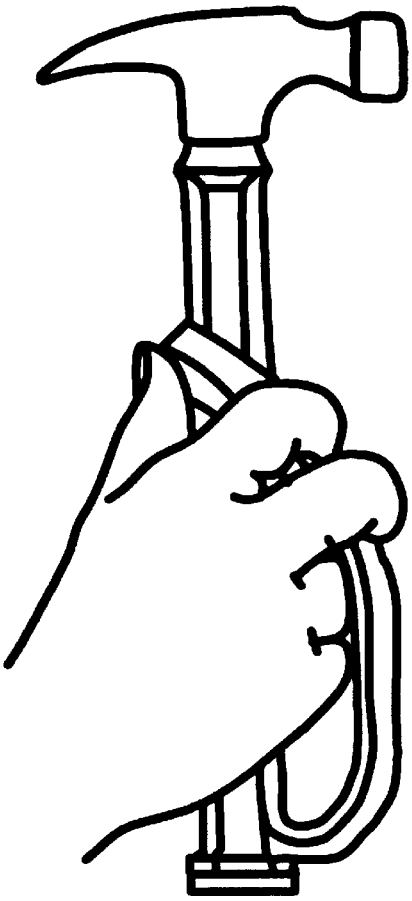
FIG. 6 is an elevational side view of the present invention showing an alternative hand position.

In use, a striking tool head (50) such as a hammer head or hatchet head is fixedly attached to the head end (21) of the shaft. When the sticking tool is swung, the striking surface (51) of the tool head (50) is substantially parallel with the lower shaft surface (25). With reference to FIG. 5, in normal use, the user's fingers are substantially protected by the finger shield (30). The rearward hand lock (33) serves to help keep the tool handle (10) from accidental release by providing an additional independent mechanism for protection against loss of grip, above and beyond the normal friction between the hand and the shaft (20). As FIG. 5 shows, the forward hand lock (32) serves to position and stabilize the user's hand on the tool handle. FIG. 5 further shows the position of the thumb located on the thumb ramp (40) to provide for additional control and accuracy during use. The thumb position along the upper shaft surface (24) allows additional control against side to side movement of the tool handle beyond what is available from the hand grip alone. In the present invention, the thumb is not merely supplementing the tightness of the grip by wrapping around the user's other fingers. Instead, the thumb is axially positioned along the shaft (20) on the thumb ramp (40), allowing subtle pressure with the user's thumb to directly affect control and stability of the tool handle (10). FIG. 6 shows a hand position when further control over the tool is required not requiring full striking forces, such as when first starting a nail or for light tapping.

As shown in FIGS. 1–5, the tool handle (10) is symmetrical from side to side. Therefore, each tool is equally well suited for use by left-handed or right-handed individuals.

The prior art discloses a tremendous variety of weights, shapes and forms for the striking tool head depending on the intended application of the tool. Typically, the finger shield (30) and thumb ramp (40) would be a of a rigid or semi-rigid structure, and be composed of one or more of the materials of construction used for the tool handle (10). However, depending on the application of the string tool, it may be preferable to utilize different materials for constructing the shaft (20), then used in the finger shield (30) or thumb ramp(40) of the tool handle (10).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tool handle for use with a striking tool head comprising:

a shaft having a head end adapted to receive the striking tool head, a free end, and a grip portion, the grip portion being adjacent to the head end and the free end; and a finger shield fixedly attached to the shaft, forming a hand passage between the finger shield and grip portion; the finger shield having a rearward hand lock being positioned on the grip portion adjacent to the free end, the finger shield further having a forward band lock being positioned on the grip portion adjacent to the head end, the forward hand lock being tapered to receive the forefinger of the user.

2. The tool handle of claim 1 further comprising a thumb ramp fixedly attached to the shaft substantially near the transition between the grip portion and the head end.

3. The tool handle of claim 2 wherein the shaft further comprises an upper shaft surface and a lower shaft surface, the upper shaft surface being immediately adjacent and enjoined to the lower shaft surface.

4. The tool handle of claim 3 wherein the thumb ramp is located on the upper shaft surface.

5. The tool handle of claim 4 wherein the finger shield is located on the lower shaft surface.

6. The tool handle of claim 5 wherein the finger shield is discontinuous.

7. A tool wherein the tool handle of claim 5 is attached to a hammer head.

8. A tool wherein the tool handle of claim 5 is attached to a claw hammer head.

* * * * *